US008398438B2

(12) United States Patent
Zhang et al.

(10) Patent No.: US 8,398,438 B2
(45) **Date of Patent: *Mar. 19, 2013**

(54) ELECTRICAL CONNECTOR

(75) Inventors: Shuqiang Zhang, Shanghai (CN); Clarence Leon Yu, Shanghai (CN); Doron Lapidot, Tokyo (JP)

(73) Assignees: Tyco Electronics Japan G.K., Kanagawa-Ken (JP); Tyco Electronics (Shanghai) Co. Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/158,828

(22) Filed: Jun. 13, 2011

(65) Prior Publication Data

US 2011/0306239 A1 Dec. 15, 2011

(30) Foreign Application Priority Data

Jun. 13, 2010 (CN) ..... 2010 1 0204807

(51) Int. Cl.
*H01R 24/00* (2006.01)

(52) U.S. Cl. ..... 439/660

(58) Field of Classification Search ..... 439/660, 439/626, 638, 79, 80, 76.1, 722, 607.35, 439/607.39, 607.04, 607.4, 607.01, 607.11, 439/540.1, 541.5

See application file for complete search history.

(56) References Cited

U.S. PATENT DOCUMENTS

| | | | | |
|---|---|---|---|---|
| 6,183,302 | B1 * | 2/2001 | Daikuhara et al. | 439/607.1 |
| 7,878,847 | B2 * | 2/2011 | He et al. | 439/541.5 |
| 7,988,499 | B2 * | 8/2011 | Lin et al. | 439/701 |
| 8,079,879 | B2 * | 12/2011 | Chiang | 439/660 |
| 2009/0042421 | A1 * | 2/2009 | Zheng et al. | 439/83 |

* cited by examiner

*Primary Examiner* — Edwin A. Leon
*Assistant Examiner* — Harshad Patel
(74) *Attorney, Agent, or Firm* — Barley Snyder

(57) ABSTRACT

The present invention discloses an electrical connector having an insulator body, a shield, and an upper and a lower rows of terminals. The shield is constructed to enclose the insulator body. The upper and a lower rows of terminals are held in the insulator body, wherein one of the two rows of terminals is a row of low speed circuit terminals and the other is a row of high speed circuit terminals having two pairs of high speed differential signal terminals and a first ground terminal. At least a portion of the first ground terminal has a width larger than a corresponding portion of each of high speed differential signal terminals. The ground terminal of the high speed circuit is widened compared with high speed differential signal terminals, and it can effectively reduce the inductive coupling crosstalk between the high speed differential signal terminals.

19 Claims, 5 Drawing Sheets

ELECTRICAL CONNECTOR

CROSS-REFERENCE TO RELATED APPLICATIONS

This application claims the benefit of the filing date under 35 U.S.C. §119(a)-(d) of Chinese Patent Application No. 201010204807.9 filed on Jun. 13, 2010.

FIELD OF THE INVENTION

The present invention relates to an electrical connector and in particular to an electrical connector being capable of transmitting high speed signals.

BACKGROUND

USB (Universal Serial Bus) is a communication standard, so far, it has been updated from a conventional USB 2.0 standard to a current USB 3.0 standard, accordingly the transmission speed thereof has been increased from 480 Mbit/s to 5 Gbit/s. USB 3.0 standard has very rigorous requests for the structure design and the electrical performance of the electrical connector interface for transmitting high speed signals.

FIG. 1A is a perspective view of two rows of terminals of a known USB connector, including a row of low speed circuit terminals 210 for transmitting low speed signals and a row of high speed circuit terminals 220 for transmitting high speed signals. The row of high speed circuit terminals 220 are positioned above the row of low speed circuit terminals 210.

FIG. 1B is an exploded view of the two rows of terminals of FIG. 1A. The row of low speed circuit terminals 210 includes a power terminal Bus, a ground terminal G1, and a pair of low speed differential signal terminals S0, S0'. The row of high speed circuit terminals 220 include a ground terminal G2 and two pairs of high speed differential signal terminals S1, S1', S2, S2'.

Referring to FIGS. 1A and 1B, the ground terminal G2 of the row of high speed circuit terminals has a same width as any one of the high speed differential signal terminals S1, S1', S2, S2', therefore, there is a relative large mutual inductance generated in the high speed circuit, causing inductive coupling crosstalk between the two pairs of high speed differential signal terminals S1, S1', S2, S2'. A connection portion 221 of each terminal of the row of high speed circuit terminals 220 extends in straight line in its whole length, and a connection portion 211 of each terminal of the row of low speed circuit terminals 210 also extends in straight line in its whole length. Accordingly, the connection portions 221 of the high speed circuit terminals 220 are parallel to and spaced from the connection portions 211 of the low speed circuit terminals 210 by a constant space.

However, in the known connector, as shown in FIG. 1A, the high speed circuit terminals 220 are spaced from the low speed circuit terminals 210 by a relative small space, causing capacitive coupling crosstalk between the high speed circuit terminals 220 and the low speed circuit terminals 210.

FIG. 3 is a perspective view of a shield 30 for a known high speed USB connector, which is not provided any additional ground terminal on the shield 30. Therefore, it may further increase the mutual inductance generated in the high speed circuit, and further increase the inductive coupling crosstalk between the two pairs of high speed differential signal terminals S1, S1', S2, S2'.

FIG. 2A shows a plastic insulation body of a known high speed USB connector. FIG. 2B is an exploded view of the plastic insulation body shown in FIG. 2A. The plastic insulation body of the known USB connector includes a base 10 and a rear retaining portion 60 separate from the base 10. After being assembled in the insulation body, as shown in FIG. 2B, each terminal is almost enclosed in the plastic insulation body only excluding a contact portion and a pin portion. Thereby, each of high speed differential signal terminals has a relative high dielectric constant, causing a signal transfer delay of the high speed differential signal terminal during transmitting signals.

Considering above disadvantages of the known high speed USB connector, such as the crosstalk between the high speed differential signal terminals and between the high speed differential signal terminals and the low speed differential signal terminals, and the signal transfer delay of the high speed differential signal terminals, it has been demanded to develop a new or novel high speed USB connector capable of overcoming or alleviating at least one aspect of the above mentioned disadvantages.

SUMMARY

An electrical connector according to the invention has been prepared to overcome, inter alia, crosstalk between the high speed differential signal terminals and between the high speed differential signal terminals and the low speed differential signal terminals, as well as a signal transfer delay of the high speed differential signal terminals.

The electrical connector having an insulator body, a shield, and an upper and lower rows of terminals. The shield is constructed for enclosing the insulator body. The upper and a lower rows of terminals held in the insulator body, one of the two rows of terminals is a row of low speed circuit terminals, and the other is a row of high speed circuit terminals including two pairs of high speed differential signal terminals and a first ground terminal. At least a portion of the first ground terminal has a width larger than that of a connection portion of each of high speed differential signal terminals.

BRIEF DESCRIPTION OF THE DRAWINGS

The present invention is illustrated in greater detail below by exemplary embodiments with reference to the attached drawings, in which.

DETAILED DESCRIPTION OF THE EMBODIMENT(S)

Figure 1A:
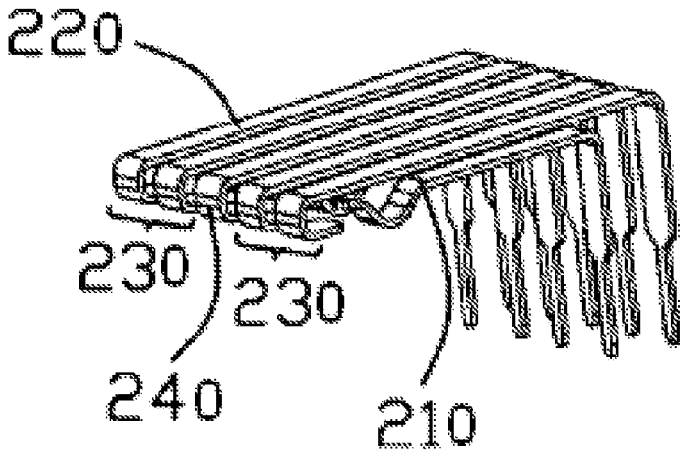
Fig. 1A PRIOR ART
FIG. 1A is a perspective view of a known high speed USB connector.
Figure 1B:
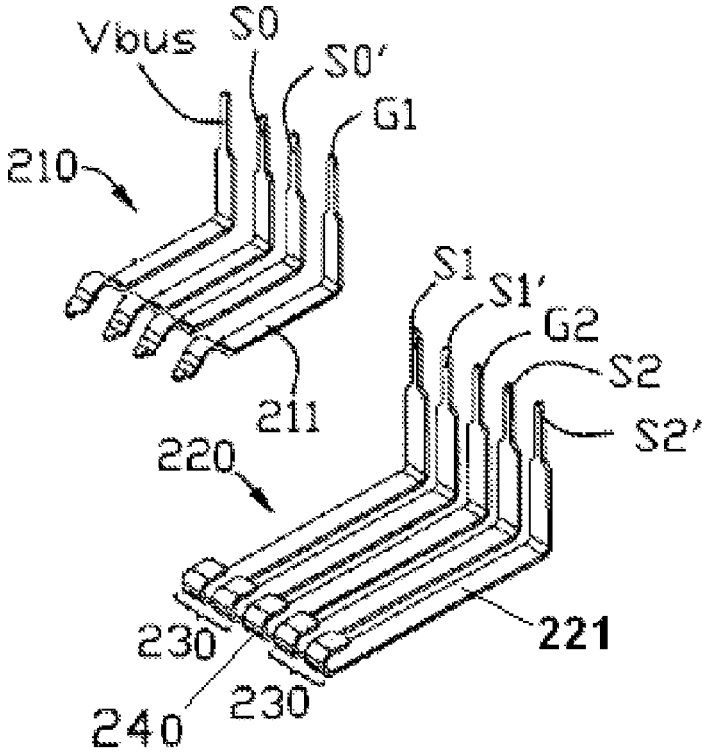
Fig. 1B PRIOR ART
FIG. 1B is an exploded perspective view of a pair of rows of known high speed USB connector of FIG. 1A.
Figure 2A:
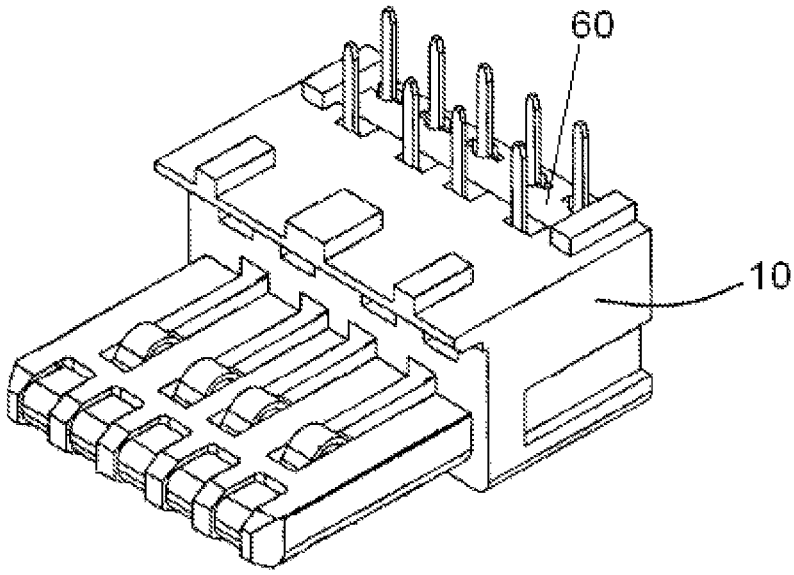
Fig. 2A PRIOR ART
FIG. 2A is a perspective view of a known high speed USB connector having a plastic insulation body.
Figure 2B:
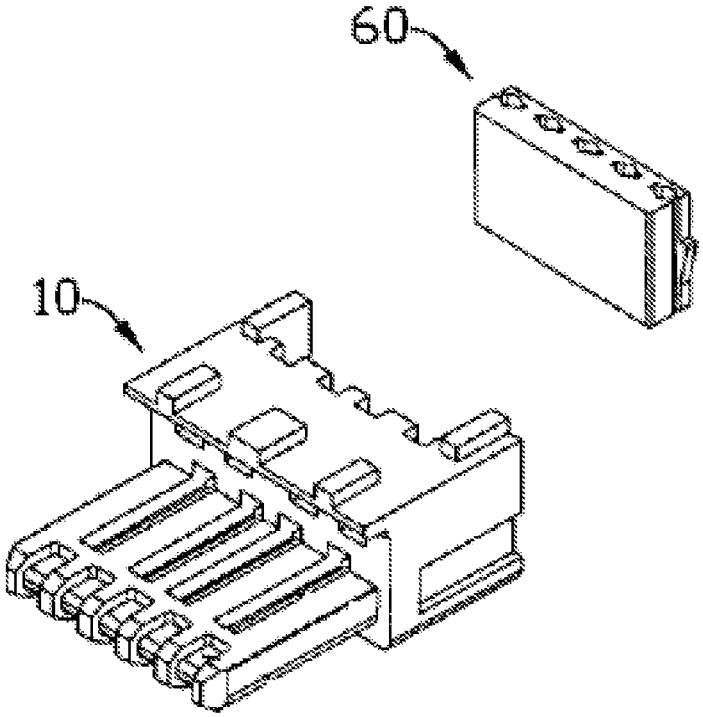
Fig. 2B PRIOR ART
FIG. 2B is an exploded view of the plastic insulation body of FIG. 2A.
Figure 3:
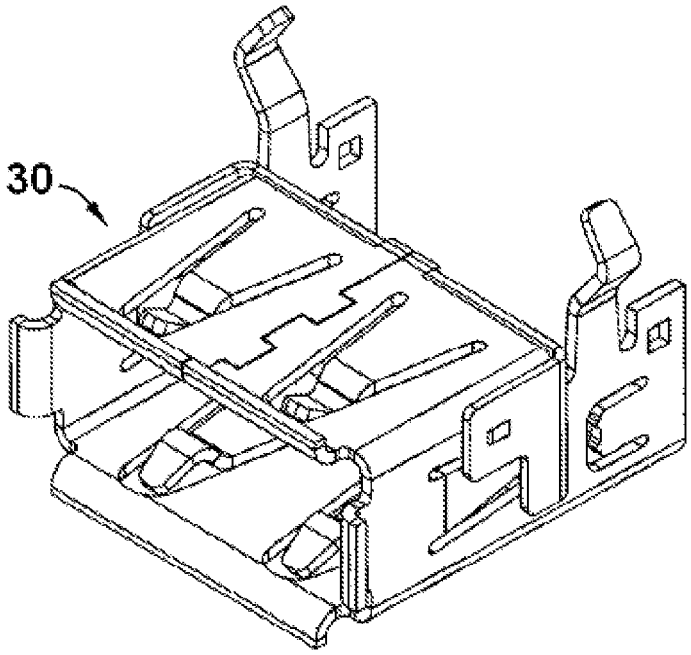
Fig. 3 PRIOR ART
FIG. 3 is a perspective view of a shield of a known high speed USB connector.

The invention is explained in greater detail below with reference to the drawings, wherein like reference numerals refer to the like elements. The invention may, however, be embodied in many different forms and should not be construed as being limited to the embodiments set forth herein; rather, these embodiments are provided so that the description will be thorough and complete, and will fully convey the concept of the invention to those skilled in the art.

Figure 4:
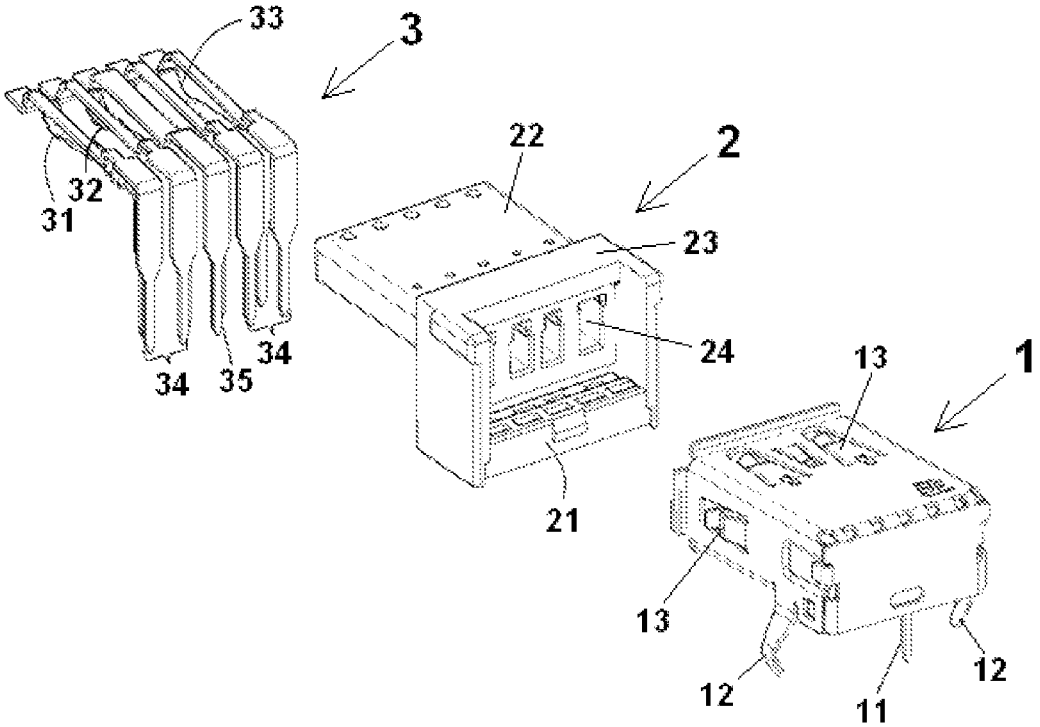
FIG. 4 is an exploded view of an electrical connector according to the invention.

With reference to FIG. 4, an electrical connector according to the invention is shown, which includes a shield 1, an insulation body 2 and two rows of terminals 31-35. The two rows of terminals 31-35 are assembled in a plurality of chambers 24 of the insulation body 2, and the shield 1 encloses the insulation body 2.

Figure 5:
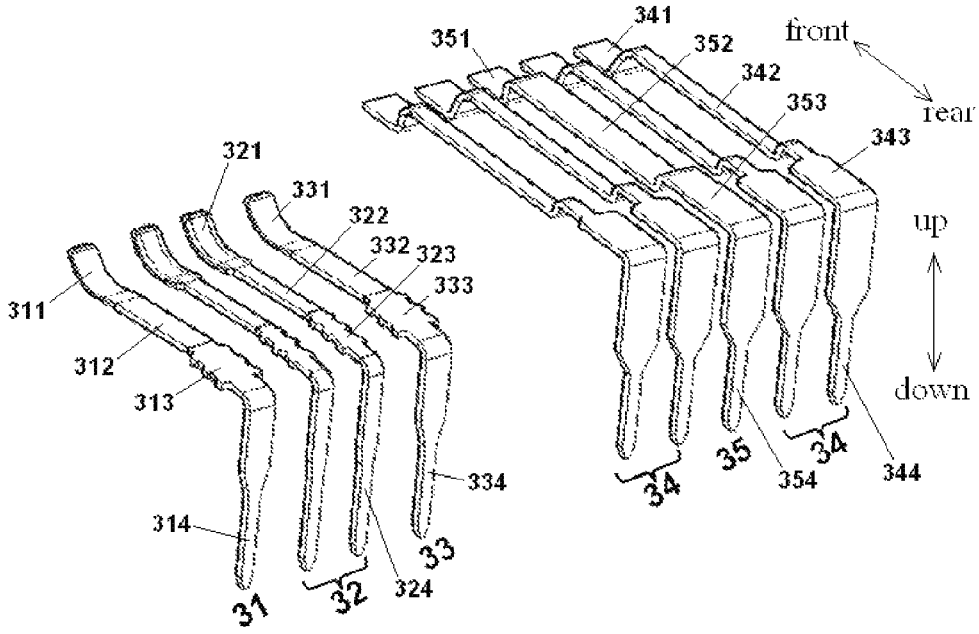
FIG. 5 is an exploded view of terminals of the electrical connector of FIG. 4.

As shown in FIG. 5, one of the two rows of terminals is a row of low speed circuit terminals 31, 32, 33 for transmitting low speed signals, and the other is a row of high speed circuit terminals 34, 35, 34 for transmitting high speed signals.

As shown in FIGS. 4 and 5, the row of high speed circuit terminals 34, 35, 34 are positioned above the row of low speed circuit terminals 31, 32, 33. The present invention is not limited to this arrangement, alternatively, the row of high speed circuit terminals 34, 35, 34 may be located below the row of low speed circuit terminals 31, 32, 33. Furthermore, the row of low speed circuit terminals 31, 32, 33 is spaced from the row of high speed circuit terminals 34, 35, 34, in the embodiment shown.

As shown in FIG. 4 and FIG. 5, the row of low speed circuit terminals 31, 32, 33 are spaced from the row of high speed circuit terminals 34, 35, 34 by the insulation body 2. The row of high speed circuit terminals includes a first ground terminal 35 and two pair of high speed differential signal terminals 34, 34. The first ground terminal 35 and the two pair of high speed differential signal terminals 34, 34 are arranged side by side in parallel to each other and have a same length with each other. The row of low speed circuit terminals includes a power terminal 31, a pair of low speed differential signal terminals 32, and a second ground terminal 33. The power terminal 31, the pair of low speed differential signal terminals 32, and the second ground terminal 33 are arranged side by side in parallel to each other and have a same length with each other. The first ground terminal 35 of the high speed circuit includes a contact portion 351, an insertion portion 354 and a connection portion 352 between the contact portion 351 and the insertion portion 354.

Two pairs of high speed differential signal terminals 34, 34 are substantively same as each other in shape and size. Moreover, the structure of each of the high speed differential signal terminals 34, 34 is similar to that of the first ground terminal 35, that is, each of the high speed differential signal terminals 34, 34 also has a contact portion 341, an insertion portion 344 and a connection portion 342 between the contact portion 341 and the insertion portion 344.

The second ground terminal 33 of the low speed circuit also has a contact portion 331, an insertion portion 334 and a connection portion 332 between the contact portion 331 and the insertion portion 334. In addition, the power terminal 31 of the low speed circuit has a contact portion 311, an insertion portion 314 and a connection portion 312 between the contact portion 311 and the insertion portion 314. In addition, each of the pair of low speed differential signal terminals 32 has a contact portion 321, an insertion portion 324 and a connection portion 322 between the contact portion 321 and the insertion portion 324.

Furthermore, the second ground terminal 33 and the power terminal 31 are substantively the same as each other in shape and size. The low speed differential signal terminals 32 are substantively the same as each other in shape and size.

The connection portion 352 of the first ground terminal 35 is designed to have a width larger than the connection portion 342 of each of high speed differential signal terminals 34, 34. Accordingly, the electrical connector can effectively reduce the inductive coupling between the high speed circuit terminals 34, 35, 34. Because inductive coupling is responsible for the crosstalk between the high speed differential signal terminals 34, 35, 34, it can effectively reduce the crosstalk between the high speed differential signal terminals. The inductive coupling may be expressed by a following formula (1):

$$V\text{noise}=Lm*(dV\text{driver}/dt) \quad (1)$$

Vnoise is the inductive coupling between the high speed circuit terminals. Lm is a mutual inductance generated in the high speed circuit, and dVdriver/dt is a speed change rate of transmitting signal through the high speed circuit terminal.

According to the above formula (1), it is apparent that the inductive coupling Vnoise between the high speed circuit terminals is caused mainly by the mutual inductance Lm generated in the high speed circuit.

In order to reduce the mutual inductance Lm generated in the high speed circuit and to effectively reduce the crosstalk between the high speed differential signal terminals, the first ground terminal 35 is widened relative to the other high speed circuit terminals 34 in the embodiment shown.

The first ground terminal 35 may be wider than each of the high speed differential signal terminals 34 in whole or in a local portion. Accordingly, if at least a part of the first ground terminal 35 is wider than a corresponding part of the high speed differential signal terminal 34, it will be within the scope and spirit of the invention.

Figure 8:
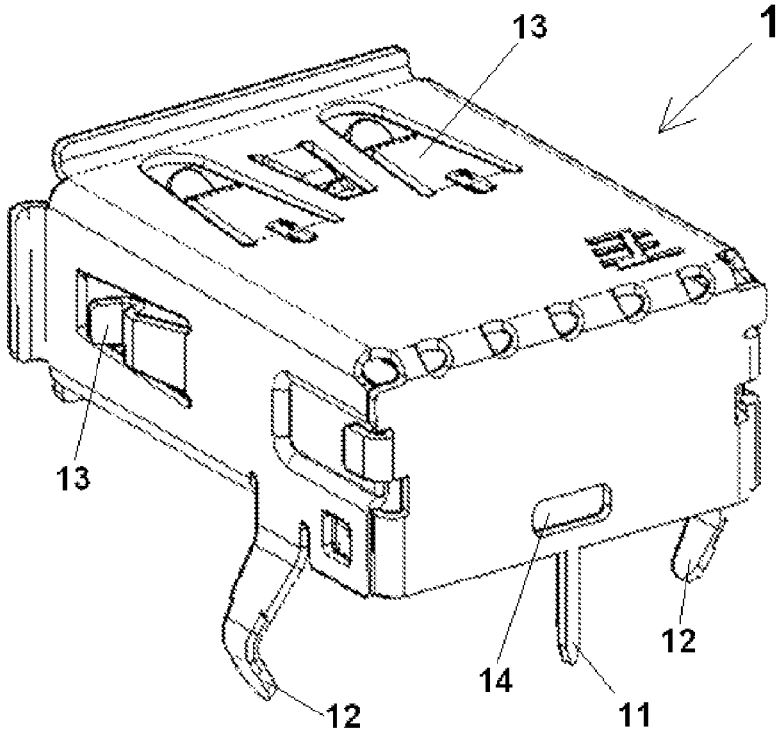
FIG. 8 is a perspective view of a shield of the electrical connector according to the invention.

With respect to FIG. 8, a shield of the electrical connector according to the invention is shown, and is formed with a third ground terminal 11 extending vertically and downwardly from the bottom of the shield 1. As a result, the inductive coupling between the high speed circuit terminals can be further reduced and the crosstalk between the high speed differential signal terminals can be further reduced, in the embodiment shown.

Referring to FIGS. 4 and 5, a rear part of the connection portion 342 of each of the high speed differential signal terminals 34, 34 is folded upwardly in a direction far away from the low speed circuit terminal to form a folding section 343. The space distance between the high speed differential signal terminal 34 and the low speed circuit terminal can be increased, and it can effectively reduce the capacitive coupling between the high speed differential signal terminal 34 and the low speed differential signal terminal 32. Because the capacitive coupling is responsible for the crosstalk between the high speed differential signal terminals and the low speed differential signal terminals, it can effectively reduce the crosstalk between the high speed differential signal terminals and the low speed differential signal terminals. The capacitive coupling may be expressed by following formulas (2) and (3):

$$I\text{noise}=Cm*(dV\text{driver}/dt) \quad (2)$$

$$Cm=\in A/d \quad (3)$$

Inoise is the capacitive coupling between the high speed differential signal terminal and the low speed differential signal terminal Cm is a capacitance between the high speed differential signal terminal and the low speed differential signal terminal, and $\in$ is a dielectric constant of the insulation material surrounding the high speed differential signal terminal and the low speed differential signal terminal A is an area of the high speed differential signal terminal facing the low speed differential signal terminal, while d is the space distance between the high speed differential signal terminal and the low speed differential signal terminal.

According to formulas (2) and (3), the capacitive coupling Inoise between the high speed differential signal terminal and the low speed differential signal terminal is inversely proportional to the distance d therebetween. Thereby, with the configuration of the folding section 343 formed by bending the high speed differential signal terminal 34 far away from the low speed circuit terminal, the distance d between the high speed differential signal terminal 34 and the low speed differential signal terminal 32 is increased, and it can effectively reduce the capacitive coupling between the high speed differential signal terminal 34 and the low speed differential signal terminal 32 and the crosstalk therebetween due to the capacitive coupling.

Similar to the high speed differential signal terminal 34, please refer to FIG. 4 and FIG. 5, a rear part of the connection portion 352 of the first ground terminal 35 also is folded upwardly in a direction far away from the low speed circuit terminal to form a folding section 353.

With reference back to FIGS. 4 and 5, a rear part of the connection portion 322 of each of the low speed differential signal terminals 32 is folded downwardly in a direction far away from the high speed circuit terminal to form a folding section 323. The space distance between the high speed differential signal terminal 34 and the low speed circuit terminal 32 can be further increased, and it can further reduce the capacitive coupling between the high speed differential signal terminal 34 and the low speed differential signal terminal 32. Because the capacitive coupling is responsible for the crosstalk between the high speed differential signal terminals and the low speed differential signal terminals, it can further reduce the crosstalk between the high speed differential signal terminals and the low speed differential signal terminals.

Similarly, a rear part of the connection portion 312 of the power terminal 31 also is folded downwardly in a direction far away from the high speed circuit terminal to form a folding section 313, and a rear part of the connection portion 332 of the second ground terminal 33 also is folded downwardly in a direction far away from the high speed circuit terminal to form a folding section 333.

As shown in FIG. 5, each of the power terminal 31 and the second ground terminal 33 has a width larger than that of each of the low speed differential signal terminals 32. But the present invention is not limited to this, each of the power terminal 31 and the second ground terminal 33 may have a width equal to that of each of the low speed differential signal terminals 32, or each of the power terminal 31 and the second ground terminal 33 may be the same as each of the low speed differential signal terminals 32 in shape and size.

Furthermore, the folding sections 343, 353 of the row of high speed circuit terminals 34, 35, 34 are upwardly protruded and then horizontally extended to form protruded flat sections, respectively. But the present invention is not limited to this, the folding sections 343, 353 of the row of high speed circuit terminals 34, 35, 34 may inclined and upwardly extended to form upward slope sections, respectively.

Figure 6:
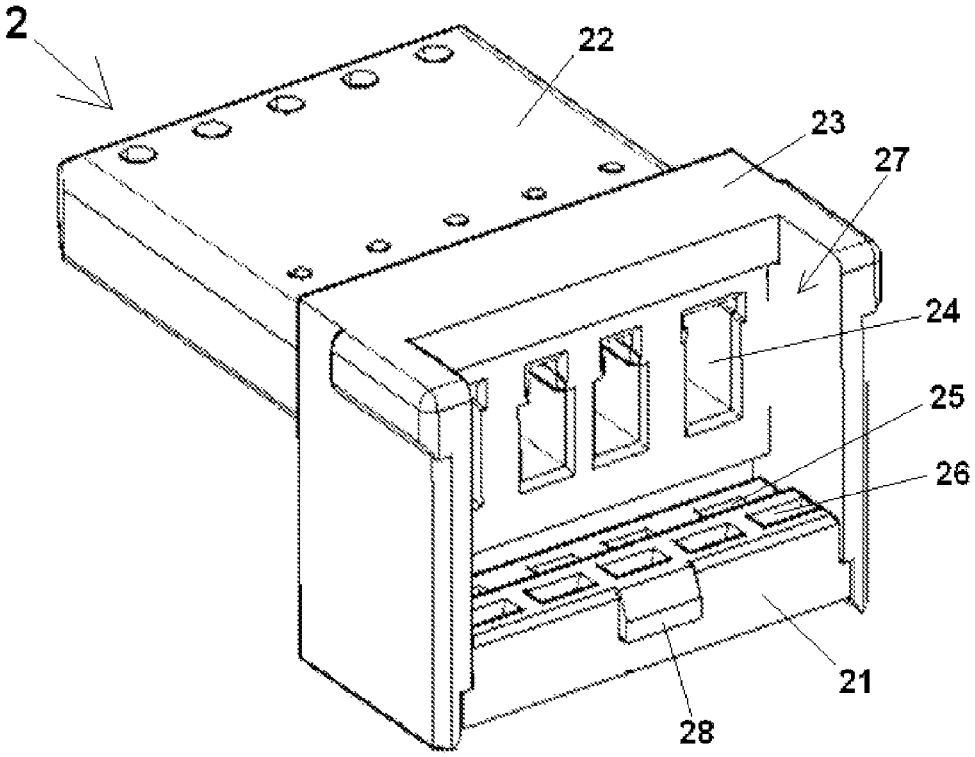
FIG. 6 is a perspective view of an insulation body of the electrical connector according to the invention.
Figure 7:
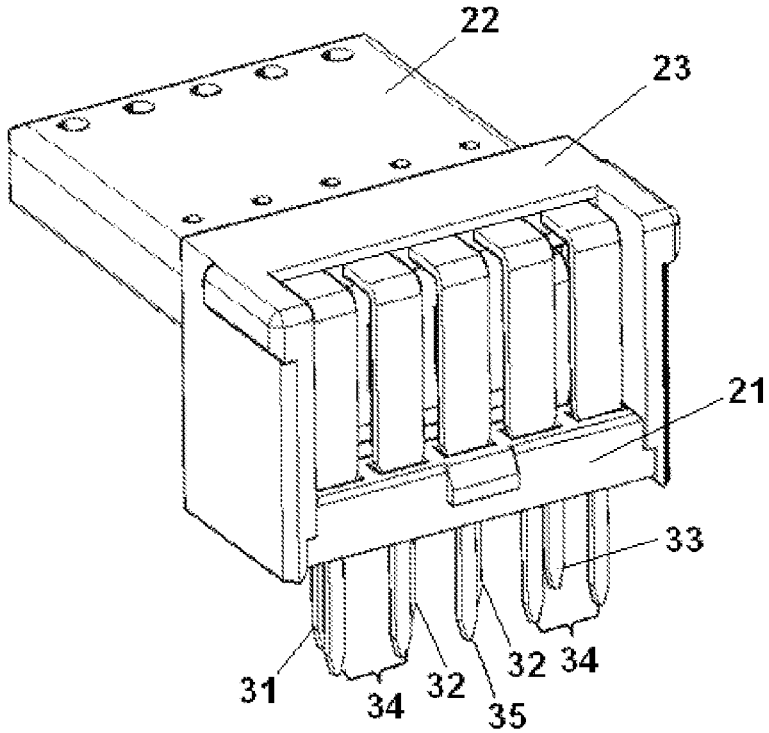
FIG. 7 is an perspective view of the insulation body according to the invention with a terminals are assembled therein.

With reference to FIG. 7, the two rows of aforementioned terminals 31-35 (shown in FIG. 5) are assembled in the insulation body. A front portion of each of folding sections 343, 353 of the high speed circuit terminals 34, 35, 34 is embedded in the insulation body 2 (see also FIG. 5), and the rear portion of each of folding sections 343, 353 of the high speed circuit terminals 34, 35, 34 is exposed out of the insulation body 2 through a window 27 (see also FIGS. 5 and 6).

The folding sections 313, 323, 333 of the row of low speed circuit terminals 31, 32, 33 are inclined and downwardly extend to form downward slope sections, respectively. But the present invention is not limited to this, the folding sections 313, 323, 333 of the row of low speed circuit terminals 31, 32, 33 may be downwardly depressed and horizontally extend to form depressed flat sections, respectively.

A front portion of each of connection portions 312, 322, 332 of the low speed circuit terminals 31, 32, 33 is embedded in the insulation body 2, and the rear portion of each of connection portions 312, 322, 332 of the low speed circuit terminals 31, 32, 33 is exposed out of the insulation body 2 through a window 27 (shown in FIG. 6).

As shown in FIGS. 6 and 7, the insulation body 2 according to the invention includes a base 23 and a tongue 22 formed in front of the base 23. Most of a rear side wall of the base 23 is removed to form a window 27 so that the high and low speed circuit terminals are exposed in air as more as possible through the window 27. Accordingly, the high and low speed circuit terminals at the rear side wall of the base 23 is surrounded by air, instead of the insulation material (for example, insulation plastic) forming the insulation body 2. Therefore, the dielectric constant of the material surrounding the high and low speed circuit terminals at the rear side wall of the base 23 can be decreased. Because the dielectric constant is one of important factors responsible for the signal transfer delay of the high speed differential signal terminals, it can effectively reduce the signal transfer delay of the high speed differential signal terminals during transmitting signals. The dielectric constant may be expressed by following formula (4):

$$\text{Propagation Delay}=L^{*}\text{sqrt}(\in)/C \tag{4}$$

Propagation Delay is the signal transfer delay of the high speed differential signal terminal during transmitting signals. L is a length of the high speed differential signal terminal, while ∈ is the dielectric constant of the insulation material surrounding the high speed differential signal terminal, and C is a velocity of light.

According to formula (4), when the length L of the high speed differential signal terminal is determined, the signal transfer delay of the high speed differential signal terminal can be effectively decreased by reducing the dielectric constant ∈ of the insulation material surrounding the high speed differential signal terminal.

As a result, by removing the rear side wall of the insulation body 2, the high speed differential signal terminals 34, 34 at the rear side wall of the insulation body 2 are surrounded by air, instead of the plastic. Thereby, the dielectric constant ∈ of the insulation material surrounding the high speed differential signal terminals is decreased so that the transmitting speed of the high speed differential signals in the high speed differential signal terminals is substantially equal to the velocity of light.

Furthermore, the embodiment shown can also decrease the capacitive coupling between the high speed differential signal terminals 34, 34, and it can effectively reduce the crosstalk between them due to the capacitive coupling. The capacitive coupling may be expressed by following formulas (5) and (6):

$$Inoise=Cm^{*}(dV\text{driver}/dt) \tag{5}$$

$$Cm=\in A/d \tag{6}$$

Inoise is the capacitive coupling between the high speed differential signal terminals, and Cm is a capacitance between the high speed differential signal terminals. The constant ∈ is a dielectric constant of the insulation material surrounding the high speed differential signal terminals, A is a area of the high speed differential signal terminals facing to each other, and d is the space distance between the high speed differential signal terminals.

According to formulas (5) and (6), the capacitive coupling Inoise between the high speed differential signal terminals is inversely proportional to the space distance d therebetween. As a result, by removing the rear side wall of the insulation body 2, the high speed differential signal terminals 34, 34 at the rear side wall of the insulation body 2 are exposed in and surrounded by air, instead of the plastic, in the shown embodiment. Thereby, the dielectric constant $\in$ of the insulation material surrounding the high speed differential signal terminals is decreased so that the crosstalk between the high speed differential signal terminals is reduced.

As shown in FIGS. 6 and 7, most of the rear side wall of the base 23 is removed excluding a small part at the bottom thereof. The remained part at the bottom of the rear side wall of the base 23 is used to form a retaining wall 21 having a small height. Two rows of insertion holes 25, 26 are formed in the retaining wall 21 to position the insertion portions 314, 324,334, 344, 354 of the two rows of terminals 31, 32, 33, 34, 35 therein.

In order to enlarge the window 27 as much as possible, the height of the retaining wall 21 is far less than that of the window 27 in the shown embodiment. Preferably, the height of the retaining wall 21 is less than a half of the height of the window 27.

The retaining wall 21 and the base 23 are integrally formed into one piece, for example, by overmolding.

The invention is however not limited to this formation, the rear side wall of the base 23 may be removed completely, and the retaining wall 21 may be a separate member and assembled in the window 27 formed by completely removing the rear side wall of the base 23.

With reference to FIG. 8, a plurality of elastic holding legs 13 are formed on the shield 1 to reliably hold the insulation body 2 in the shield 1.

Referring now to both FIGS. 6 and 8, a protrusion 28 is formed on the retaining wall 21 of the insulation body 2, and an opening 14 is formed in the rear side wall of the shield 1 to be fitted with the protrusion 28 of the retaining wall 21. When the insulation body 2 is assembled in the shield 1, the protrusion 28 of the retaining wall 21 is engaged with the opening 14 of the shield 1 to latch the shield 1 and the insulation body 2 together.

The electrical connector according to the invention conforms with the know USB 3.0 standard, the row of low speed circuit terminals are compatible with the known USB 2.0 connector for transmitting low speed signals, and the row of high speed circuit terminals are used to transmit high speed signals according to USB3.0 communicating protocol.

In some embodiments of the present invention, at least part of the first ground terminal 35 of the high speed circuit is widened compared with high speed differential signal terminals 34, 34 of the high speed circuit, and it can effectively reduce the inductive coupling crosstalk between the high speed differential signal terminals 34, 35, 34. Furthermore, in some embodiments of the present invention, the connection portion 342 of the high speed differential signal terminal 34 is folded away from the low speed circuit terminal 32, and it increases the space between the high speed differential signal terminal 34 and the low speed circuit terminal 32 and can effectively reduce the capacitive coupling crosstalk therebetween. Moreover, in some embodiments of the present invention, the most of the rear side wall of the base 23 of the insulation body 2 is cut off to form a window 27 for exposing terminals in air as more as possible, and it reduces the dielectric constant of the terminals, and can effectively reduce the signal transfer delay of the high speed differential signal terminals 34 and can further reduce the capacitive coupling crosstalk therebetween.

Although several embodiments have been shown and described, it would be appreciated by those skilled in the art that various changes or modifications may be made in these embodiments without departing from the principles and spirit of the disclosure, the scope of which is defined in the claims and their equivalents. It should be noted that the term "comprising" does not exclude other elements or steps and the "a" or "an" does not exclude a plurality. It should also be noted that reference signs in the claims shall not be construed as limiting the scope of the claims.

What is claimed is:

1. An electrical connector, comprising:

an insulator body;

a shield for enclosing the insulator body; and an upper and a lower rows of terminals held in the insulator body, one of the two rows of terminals is a row of low speed circuit terminals, and the other is a row of high speed circuit terminals including:

two pairs of high speed differential signal terminals with each of the high speed differential signals having terminal contact portion, a terminal connection portion bent from the terminal contact portion, and a terminal insertion portion bent from the terminal connection portion, the terminal connection portion having a terminal folding section folded away from lower row of speed terminals; and a first ground terminal having a ground contact portion, a ground insertion portion and a ground connection portion positioned between the ground contact portion and the ground insertion portion, the ground connection portion having a ground folding section folded away from lower row of speed terminals;

wherein each terminal connection portion and the ground connection portion are arranged side by side and extend parallel to each other with the ground connection portion between the ground contact portion and the ground folding section having a greater width than that of each terminal connection portion between terminal contact portion and the terminal folding section.

2. The electrical connector according to claim 1, wherein each of terminal folding section and ground folding section are positioned side by side and extend horizontally.

3. The electrical connector according to claim 2, wherein at least a portion of each terminal folding section and ground folding section is embedded in the insulator body and another portion of each terminal folding section and ground folding section is exposed out of the insulator body.

4. The electrical connector according to claim 1, wherein the row of low speed circuit terminals includes a pair of low speed differential signal terminals.

5. The electrical connector according to claim 4, wherein each of the low speed differential signal terminals has a contact portion, an insertion portion and a connection portion between the contact portion and the insertion portion.

6. The electrical connector according to claim 5, wherein a part of the connection portion of the low speed differential signal terminal is folded away from the high speed circuit terminal to form a folding section.

7. The electrical connector according to claim 6, wherein the row of low speed circuit terminals further includes a power terminal having a contact portion, an insertion portion and a connection portion between the contact portion and the insertion portion.

8. The electrical connector according to claim 7, wherein a second ground terminal having a contact portion, an insertion portion and a connection portion between the contact portion and the insertion portion.

9. The electrical connector according to claim 8, wherein a part of each of connection portions of the power terminal and the second ground terminal is folded away from the high speed circuit terminals to form a folding section.

10. The electrical connector according to claim 9, wherein each of folding sections of the row of low speed circuit terminals is inclined.

11. The electrical connector according to claim 10, wherein each of folding sections of the row of low speed circuit terminals includes a portion embedded in the insulator body and another portion exposed out of the insulator body.

12. The electrical connector according to claim 4, wherein a third ground terminal is additionally formed on the shield.

13. The electrical connector according to claim 1, wherein the insulation body includes a base and a tongue formed in front of the base.

14. The electrical connector according to claim 13, wherein the base is formed with a window at a rear side thereof, and at least a part of each of the two rows of terminals is exposed in air through the window.

15. The electrical connector according to claim 14, wherein a retaining wall is positioned at a bottom of the window of the base, and two rows of insertion holes are formed in the retaining wall to position the insertion portions of the two rows of terminals therein.

16. The electrical connector according to claim 15, wherein the retaining wall has a height smaller than a height of the window.

17. The electrical connector according to claim 16, wherein the height of the retaining wall is smaller than a half of the height of the window.

18. The electrical connector according to claim 17, wherein the retaining wall and the base are integrally formed.

19. The electrical connector according to claim 17, wherein the retaining wall is a separate member assembled in the bottom of the window of the base.

* * * * *